US006585102B2

(12) United States Patent
Gammerler et al.

(10) Patent No.: US 6,585,102 B2
(45) Date of Patent: Jul. 1, 2003

(54) METHOD AND AN APPARATUS FOR THE RE-ORIENTATION OF PRINTED PRODUCTS

(75) Inventors: Gunter Gammerler, Gelting (DE); Jürgen Dichtl, Wolfratshausen (DE)

(73) Assignee: Gammerler AG, Geretsried-Gelting (DE)

( * ) Notice: Subject to any disclaimer, the term of this patent is extended or adjusted under 35 U.S.C. 154(b) by 0 days.

(21) Appl. No.: 09/852,128

(22) Filed: May 9, 2001

(65) Prior Publication Data

US 2002/0003078 A1 Jan. 10, 2002

(30) Foreign Application Priority Data

May 17, 2000 (DE) ..... 100 24 357

(51) Int. Cl.[7] ..... B65G 47/24
(52) U.S. Cl. ..... 198/416; 198/411
(58) Field of Search ..... 198/411, 416, 198/457.05

(56) References Cited

U.S. PATENT DOCUMENTS

| | | | | | |
|---|---|---|---|---|---|
| 4,724,945 | A | * | 2/1988 | Martin | 198/416 X |
| 4,927,133 | A | * | 5/1990 | Evans | 198/416 X |
| 4,967,899 | A | | 11/1990 | Newsome | 198/411 |
| 5,114,137 | A | | 5/1992 | Olson | |
| 5,660,262 | A | * | 8/1997 | Landrum et al. | 198/416 X |
| 5,667,214 | A | * | 9/1997 | Belec et al. | 198/416 X |
| 5,692,746 | A | | 12/1997 | Herrick, Jr. | |
| 5,924,549 | A | * | 7/1999 | Risley | 198/416 |
| 5,992,610 | A | | 11/1999 | Dufour et al. | 198/377.06 |
| 6,173,828 | B1 | | 1/2001 | Leu et al. | 198/416 |

FOREIGN PATENT DOCUMENTS

| | | | | |
|---|---|---|---|---|
| CH | 637 900 | | 8/1983 | |
| DE | 22 51 108 | C3 | 10/1972 | |
| DE | 24 38 181 | A | 8/1974 | |
| DE | 41 34 009 | A1 | 10/1991 | |
| DE | 43 00 854 | A1 | 7/1994 | |
| EP | 0 897 890 | A2 | 7/1998 | |
| EP | 8 901 977 | A1 | 8/1998 | 198/416 |
| GB | 14 24 344 | | 8/1972 | |
| GB | 1 394 599 | | 5/1975 | |
| GB | 2 264 930 | A | 9/1993 | |
| JP | 63-37021 | * | 2/1988 | 198/416 |

OTHER PUBLICATIONS

German Search Report of Dec. 28, 2000.

* cited by examiner

*Primary Examiner*—James R. Bidwell
(74) *Attorney, Agent, or Firm*—Fitch, Even, Tabin, & Flannery

(57) ABSTRACT

In a method for the re-orientation of printed products which are conveyed in an overlapping stream on a product support, the products are rotated relative to the supplied overlapping stream in an acting means in order to allow lateral cutting at two sides.

14 Claims, 1 Drawing Sheet

14
40
10
16
P
R
30
2C
36
34
B1
B2
38
22
X
B
12
II
45°
26
20
24
28

METHOD AND AN APPARATUS FOR THE RE-ORIENTATION OF PRINTED PRODUCTS

FIELD OF THE INVENTION

The present invention relates to a method and an apparatus for the re-orientation of products, in particular of printed products, which are conveyed on a product support in a product stream, in particular an overlapping stream.

BACKGROUND OF THE INVENTION

Such apparatuses are generally known and serve to have an effect on a supplied flow of printed products such that the individual printed products have a different orientation relative to the conveyer means after passing through the acting means than prior to entering the acting means. For the event that the printed products are to be cut at two or three sides, an overlapping stream first passes through a cutting station at which the printed products are cut, for example, at two parallel opposite sides. To subsequently allow a cut at one of the remaining sides or at the two remaining sides, it is necessary to change the orientation of the printed products within the overlapping stream, i.e. the products must be rotated within the overlapping stream.

It is the object of the invention to provide a method and an apparatus for the re-orientation of printed products with which a fast rotation of the printed products can take place at high conveying speeds without the proper orientation of the product stream being impaired.

SUMMARY OF THE INVENTION

This object is solved in particular by a method for the re-orientation of printed products which are conveyed in a product stream on a product support, with the products being moved at one point in time exclusively by translation relative to the supplied product stream in an acting means and being rotated at another point in time around an axis perpendicular to the conveying plane of the product support. In accordance with the invention, an exclusively translatory movement is carried out an one point in time for the re-orientation of the products supplied in the product stream, i.e. each single product is displaced in a straight line. The product is rotated on the product support at another point in time.

The invention can be used both with single products supplied in a product stream and with products supplied in an overlapping stream.

It is possible with the method in accordance with the invention to change the original impulse of an incoming overlapping stream orientated in the conveying direction by moving the product to be turned exclusively by translation relative to the supplied overlapping stream. The rotation of the product can be controlled better in this way.

Advantageous embodiments of the invention are described in the description, the drawings and the dependent claims.

In accordance with an advantageous embodiment, the one point in time is temporally before the other point in time, i.e. the products are first moved exclusively by translation relative to the supplied product stream and subsequently turned around an axis perpendicular to the conveying plane of the product support. It can be advantageous here if a translatory movement of the individual products is also made during the rotation. In this variant, the individual products of the product stream are thus supplied in the conveying direction, first moved exclusively by translation relative to the supplied product stream in the acting means and subsequently further by translation conveyed and rotationally moved.

In accordance with a further advantageous embodiment, the conveying direction of the product stream is changed in the acting means. This means that a rotation of the individual products through an angle of less than 90° is required for a re-orientation of the products within the product stream by 90°. If, for example, the conveying means of an overlapping stream is changed by 45° in the acting means, then the individual printed products must also only be turned through an angle of 45° inside the acting means, which contributes to the stabilization of the outgoing overlapping stream.

The rotation of the individual products inside the overlapping stream can preferably be carried out by moving the products against an obstacle which is preferably curved, but which is in particular not curved in a circular manner. It is possible, for example, to provide a stop extending in a curved profile as the obstacle, which the products impact after the exclusively translatory movement, whereby the rotational movement to re-orientate the products is initiated.

In accordance with a further advantageous embodiment, while the translatory movement is carried out in the same direction with respect to the conveying direction of the incoming product stream, it is not done transversely, i.e. at a right angle to this conveying direction, but obliquely thereto. This means that the individual products are obliquely drawn out from the overlapping stream, which is preferably done by the gripping of each individual printed product. For example, an individual printed product can be gripped at a corner with the aid of a pair of rolls and drawn out a little from the overlapping stream, whereby a translatory velocity component is applied to this product which can preferably be in the direction of the outgoing overlapping stream.

In accordance with a further advantageous embodiment, the product stream is guided via a stationary portion of the product support in the acting means. This has the big advantage that the products are no longer driven in the conveying direction during re-orientation, but that the re-orientation can take place at the stationary portion of the product support.

The object initially mentioned can further be satisfied by an apparatus for the re-orientation of products conveyed in a product stream comprising a product support and an acting means in which the individual products are rotated around an axis parallel to the product support, with the product support comprising an incoming conveyor belt, an outgoing conveyor belt and a stationary support section therebetween. As was already explained above, the advantage results in this way that the re-orientation of the individual products within the product stream can take place free of that movement which is applied by the incoming and/or outgoing conveyor belt. The products can be uncoupled from the incoming product stream at the stationary support section, be moved by translation and rotationally and thereby be re-orientated, and subsequently be transported onto the outgoing conveyor belt. It is advantageous here if the support section has a smooth surface, for example metallic, surface in order to reduce the friction between the product section and the support section.

In accordance with an advantageous embodiment, the acting means comprises an obstacle which is arranged in a stationary manner and which is formed in a curved, and preferably flexible, manner. The individual products can be rotated in a particularly gentle manner by a stop with such a curved profile, with a flexible design of the stop making the adjustment and matching to different shapes or different products easier.

In accordance with a further advantageous embodiment, the obstacle comprises a longitudinal extent and two end regions, with the one end region of the obstacle or the stop being orientated at a right angle to the conveying direction of the incoming conveyor belt and the other end region being orientated parallel to the conveying direction of the outgoing conveyor belt. A stop is provided in this way which the products impact at right angles—at a small portion—but which stabilizes the subsequent rotational movement of the products and which aligns the outgoing, re-orientated overlapping stream correctly in a straight line. It is of advantage here if the relative position between the other end region and the conveying direction of the outgoing conveyor belt is adjustable, since a matching to the shape can be carried out in a simple manner in this way.

The acting means preferably comprises a driven roll which is arranged above the stationary support section. The exclusively translatory movement is thereby transmitted to the product in the region of the stationary support section such that the re-orientation can take place with low friction and without distributing external forces.

In accordance with a further embodiment of the invention, the acting means comprises pressure members which cooperate with the driven roll in order to allow a drawing out of a product from the product stream with the aid of the driven roll. In this embodiment, two printed products lying on top of one another in a displaced manner are pressed by the pressure members so that the bottommost product can be drawn out from the overlapping stream with the aid of the driven roll or the driven roll pair.

BRIEF DESCRIPTION OF THE DRAWINGS

The present invention is described below purely by way of example using advantageous embodiments and with reference to the enclosed drawings, in which are shown.

DETAILED DESCRIPTION OF THE PREFERRED EMBODIMENTS

Figures 1, 2:
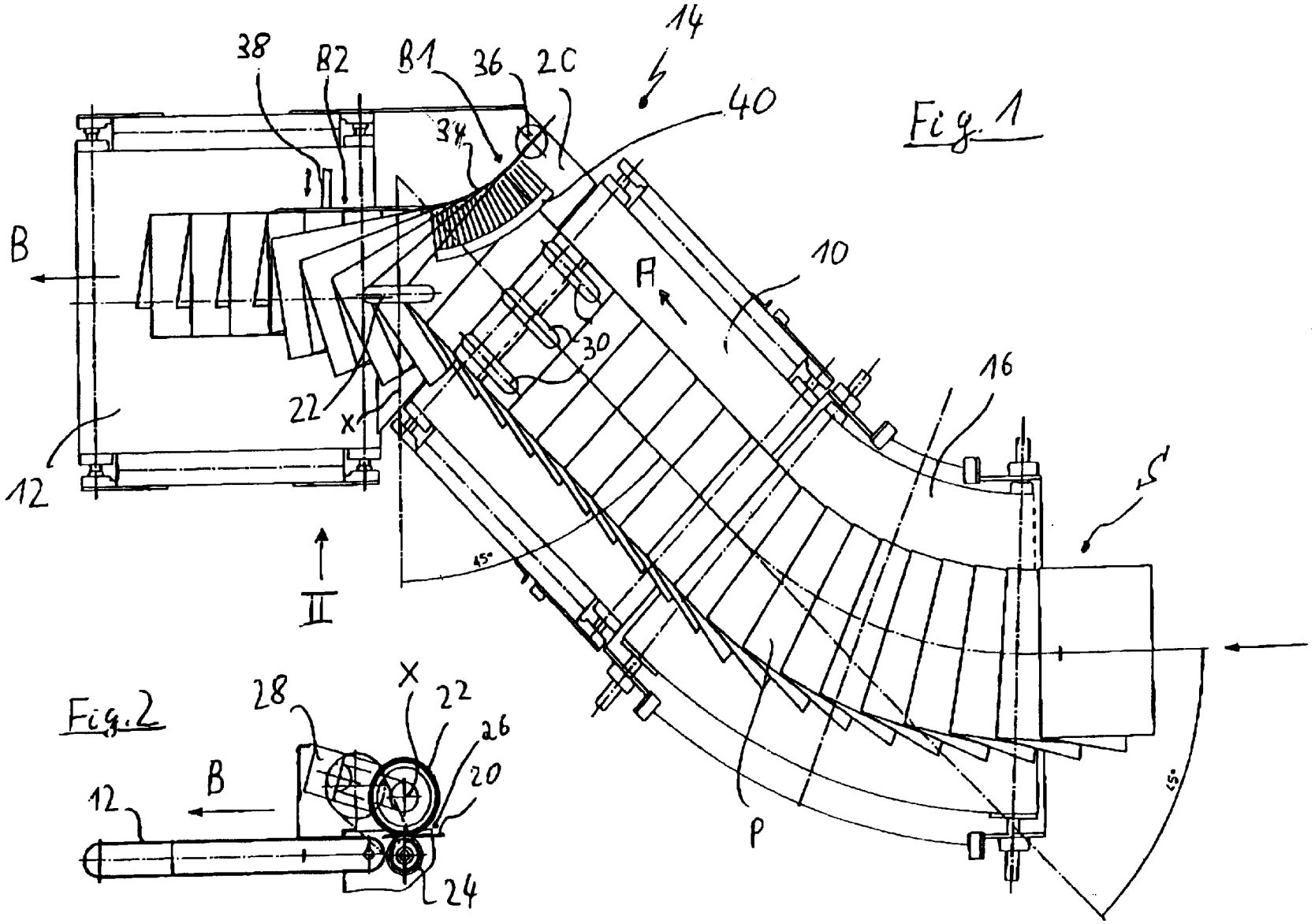
FIG. 1 a plan view of an apparatus in accordance with the invention for the re-orientation of products.
FIG. 2 a side view of a part of the apparatus of FIG. 1 in the direction of the arrow II of FIG. 1

FIG. 1 shows an apparatus for the re-orientation of printed products P conveyed in an overlapping stream S comprising an acting means 14 in which the orientation of the products P of the overlapping stream S is changed relative to the conveying direction of the overlapping stream, i.e. the individual products of the overlapping stream are rotated around an axis perpendicular to a product support in the acting means 14.

The acting means 14 comprises an incoming conveyor belt 10 and an outgoing conveyor belt 12, with the conveying direction A of the incoming conveyor belt 10 and the conveying direction B of the outgoing conveyor belt 12 forming an angle of 45°. The incoming conveyor belt 10 is preceded by a feed belt 16 which is formed in a curved manner in a plan view and thereby effects a deflection of the product conveying direction by 45°. As FIG. 1 shows, the product stream (in the plan view of FIG. 1) is thus first deflected to the right by 45° by the feed belt 16; subsequently, a straight-line continued guiding is effected by the incoming conveyor belt 10; and a change in direction of the product conveying direction by 45° to the left by the acting means 14. This means, in other words, that the product conveying direction has actually been somewhat displaced in parallel overall, but that the original conveying direction is present after the outward movement of the overlapping stream from the outgoing conveyor belt 12. The conveying direction of the overlapping stream is, however, changed in the acting means, and indeed by the conveyor belts 10 and 12 arranged obliquely with respect to one another.

As FIG. 1 further shows, a stationary support section 20 is provided between the incoming conveyor belt 10 and the outgoing conveyor belt 12 which consists in the embodiment shown of a stainless steel plate which connects the incoming conveyor belt 10 and the outgoing conveyor belt 12 to one another. The product support in the acting means is thus formed by the moving upper run of the incoming conveyor belt 10, by the stationary support section 20 and by the moving upper run of the outgoing conveyor belt 12.

For the reorientation of the individual products P of the overlapping stream S, the acting means 14 comprises a synchronously driven roll pair 22, 24 (FIG. 2) which forms a clamping gap 26 therebetween which is in the plane of the stationary support section 20. For this purpose, the stationary support section 20 is cut out at this point. The axes of rotation of the roll pair 22, 24 extend at right angles to the conveying direction B of the outgoing conveyor belt 12, parallel to the plane of the product support and at an angle of 45° to the conveying direction A of the incoming conveyor belt 10 (cf. FIG. 1). The roll pair 22, 24 is adjustable in the direction of the axis of rotation X with the aid of an adjusting device 28.

Three pressure rolls 30 are provided in the region of the incoming conveyor belt 10—at its ends and above its upper run—which press onto the overlapping stream S from above and thereby make it possible for a product lying at the bottom to be drawn out from the overlapping stream by the roll pair 22, 24. The axis of rotation of the pressure rolls 30 extends at a right angle to the conveying direction A of the incoming conveyor belt 10 and is arranged, seen in a plan view, a little upstream with respect to the downstream deflecting roll of the incoming conveyor belt 10.

To effect a rotation of the individual printed products, the acting means 14 comprises an obstacle in the form of a stop 34 which is formed as an elongate metal band which extends perpendicular to the plane of the stationary support section 20. The stop 34 is guided in a guide 36 which is stationary and comprises a slot which is orientated at a right angle to the conveying direction A of the incoming conveyor belt 10. While the stop 34 can thus be guided through the slot, it is always ensured that that region B1 of the stop 34, which the supplied product first impacts, is orientated at exactly a right angle to the conveying direction A of the incoming conveyor belt 10. The other end of the curved and flexible stop 34 is guided in a region B2 parallel to the conveying direction B of the outgoing conveyor belt 12, with the stop 34 being fastened to an adjustment device 38 in the region B2 with which the region B2 of the stop 34 can be adjusted perpendicularly to the conveying direction B of the outgoing conveyor belt 12. With an appropriate adjustment along the double arrow shown in FIG. 1, the stop 34 can be reguided through the slot of the guide 36. A brush 40 is provided above the overlapping stream S and in front of the stop 34 in the conveying direction for the stabilization of the rotating products.

The functioning of the apparatus described is explained in the following.

The incoming overlapping stream S first comes onto the feed belt 16 which is formed as a 45° curve and effects a deflection of the overlapping stream by 45°. The overlapping stream is subsequently passed to the incoming conveyor belt 10, whereby the overlapping stream S is conveyed in the conveying direction A. The overlapping stream S is fixed in place at the end of the incoming conveyor belt 10 by the pressure rolls 30 such that subsequently a product can be drawn out from the overlapping stream S by the roll pair 22, 24.

The apparatus is set such that a product is gripped at its corner by the roll pair 22, 24 before this product contacts the stop 34. In this way, this product is somewhat drawn out from the overlapping stream S with an exclusively translatory movement and moved in the direction B, i.e. already accelerated in the direction of the outgoing overlapping stream.

This product subsequently impacts the region B1 of the stop 34, whereby the rotational movement of the individual products represented in FIG. 1 is initiated. At the same time, however, the product is further moved in a translatory manner in direction B by the roll pair 22, 24. However, the product simultaneously rotates due to the impulse of the product which has been conveyed from the conveyor belt 10 to the stationary support section 20, whereby the rotational movement can be steered under controlled conditions by the stop 34 serving as a guiding curve. In this way, a correctly orientated stream is again formed on the outgoing conveyor belt 12, with, however, the products having been rotated through 90°. Since the conveying directions A and B of the conveyor belts 10 and 12 are, however, orientated at 45° with respect to one another, only a rotation of the product through 45° actually has to be carried out in the region of the acting means 14. Since the stop 34 goes from its initially straight course B1 to a subsequently curved profile and further again into a straight-line region B2, a controlled re-orientation of the overlapping stream becomes possible.

The apparatus shown furthermore has a self-ordering effect, i.e. even an irregularly aligned incoming overlapping stream is aligned better again, i.e. correctly and in a straight line, after passing through the acting means 14. The described apparatus has a self-ordering effect since misorientations of the incoming products are compensated by the combination of the translatory movement and the rotary movement. Furthermore, the correct rotation is largely independent of the velocity of the overlapping stream.

The present invention can also be used in the same way for the re-orientation of individual products.

The stop 34 can also be formed as the run of a preferably motorized conveyor belt which is orientated perpendicularly to the stationary support 20 and which runs with the rotating product. A rotating brush can likewise be used instead of the conveyor belt.

We claim:

1. A method for the re-orientation of printed products, which are conveyed in a product stream on a product support, comprising moving the products exclusively by translation in an acting means relative to a supplied product stream at one point in time, and rotating the products around an axis perpendicular to a conveying plane of the product support at another point in time, wherein the translatory movement is made in the same direction and obliquely but not at right angles, to the conveying direction of the inflowing product stream.

2. A method in accordance with claim 1, wherein the one point in time is temporally before the other point in time.

3. A method in accordance with claim 1, wherein during the rotation of the products at the other point in time, the products are simultaneous also moved by translation.

4. A method in accordance with claim 1, wherein a conveying direction of the product stream is changed in the acting means.

5. A method in accordance with claim 1, wherein the rotation is effected by a movement of the products against an obstacle that is curved in a non-circular manner.

6. A method in accordance with claim 1, including guiding the product stream over a stationary portion of the product support in the acting means.

7. A method for the re-orientation of printed products, which are conveyed in a product stream on a product support, comprising moving the products exclusively by translation in an acting means relative to a supplied product stream at one point in time, and rotating the products around an axis perpendicular to a conveying plane of the product support at another point in time, wherein the product stream is an overlapping product stream, and gripping and drawing out at least a portion of a single product from the overlapping stream during the translatory movement.

8. An apparatus for the re-orientation of products conveyed in a product stream, the apparatus comprising a product support and an acting means in which the individual products are rotated around an axis perpendicular to the product support, with the product support comprising an incoming conveyor belt, an outgoing conveyor belt and a stationary support section therebetween, wherein the acting means comprises a driven roll which is arranged above the stationary support section and pressure elements which cooperate with the driven roll in order to allow a drawing out of a product from the product stream with the aid of the driven roll.

9. An apparatus for the re-orientation of products conveyed in a product stream, the apparatus comprising a product support and an acting means in which the individual products are rotated around an axis perpendicular to the product support, with the product support comprising an incoming conveyor belt, an outgoing conveyor belt and a stationary support section therebetween, the stationary support section supporting the products as the products are rotated around the perpendicular axis, wherein the acting means comprises an obstacle having a longitudinal extent and two end regions, the obstacle being oriented at a right angle to a conveying direction of the incoming conveyor belt at one of the end regions and parallel to another conveying direction of the outgoing conveyor belt at the other end region.

10. An apparatus in accordance with claim 9, wherein the support section has a smooth surface.

11. An apparatus in accordance with claim 9, wherein the acting means comprises a driven roll which is arranged above the stationary support section.

12. An apparatus for the re-orientation of products conveyed in a product stream, the apparatus comprising a product support and an acting means in which the individual products are rotated around an axis perpendicular to the product support, with the product support comprising an incoming conveyor belt, an outgoing conveyor belt and a stationary support section therebetween, wherein the acting means comprises an obstacle which is arranged in a stationary manner and which is made in a curved shape and is flexible.

13. An apparatus in accordance with claim 12, wherein the obstacle has a longitudinal extent and two end regions and is orientated at a right angle to a conveying direction of the incoming conveyor belt at its one end region an parallel to a conveying direction of the outgoing conveyor belt at its other end region.

14. An apparatus in accordance with claim 13, wherein the relative position between the other end region and the conveying direction of the outgoing conveyor belt is adjustable.

* * * * *